United States Patent [19]

Vitacco

[11] Patent Number: 4,947,931

[45] Date of Patent: Aug. 14, 1990

[54] PLASTIC VEHICULAR RADIATOR-CONDENSER WITH METAL COOLING INSERTS

[76] Inventor: Richard L. Vitacco, 1653 Thurston Ave., Racine, Wis. 53405

[21] Appl. No.: 458,414

[22] Filed: Dec. 28, 1989

[51] Int. Cl.[5] ..... F28D 1/00

[52] U.S. Cl. ..... 165/148; 165/140; 165/180

[58] Field of Search ..... 165/140, 152, 153, 148, 165/180

[56] References Cited

U.S. PATENT DOCUMENTS

| | | | |
|---|---|---|---|
| 801,397 | 10/1905 | Ray | 165/148 |
| 1,356,676 | 10/1920 | Weller et al. | 165/148 |
| 1,468,686 | 9/1923 | Wolfe | 165/152 |
| 1,726,360 | 8/1929 | Modine | 165/152 |
| 2,505,790 | 5/1950 | Panthofer | 165/140 |
| 3,265,126 | 8/1966 | Donaldson | 165/140 |
| 4,529,034 | 7/1985 | Saperstein | 165/134.1 |

*Primary Examiner*—Martin P. Schwadron
*Assistant Examiner*—Allen J. Flanigan

[57] ABSTRACT

An economical, compact, universal model radiator-condenser for motor vehicles molded in Nylon plastic and designed not to exceed the overall outside dimensions of the heat exchange system it is to replace. It has two inside divider walls (11*a*) and (11*b*) and a number of connecting spaced chambers (12) that extend vertically from the top tank (14) to bottom tank (16). Each chamber or conduit contains a multitude of slotted openings (32) on the front and back. An angular aluminum louvered (42) cooling strip (34) with deep cavity formed baffles (36); made from coil stock on a high speed die formed rolling machine; is secured by bonding or other means to the front and back of each chamber (12) with the baffles (36) projecting thru the slots (32) and into the chamber (12). As fluid passes over these baffles heat is taken out of the liquid and transfered thru these baffles (36) to the louvered (42) surface of the metal strip (34) where it is cooled off by the action of the internal engines fan and movement of the vehicle. There is also an independent chamber (13) for cooling the oil on vehicles equipped with automatic transmissions. On the condenser side of the unit a sharp reduction in the use of Freon gas is anticipated due to the increased heat transfer surface and turbulating effect of the interior cooling baffles.

1 Claim, 2 Drawing Sheets

FIG. 3
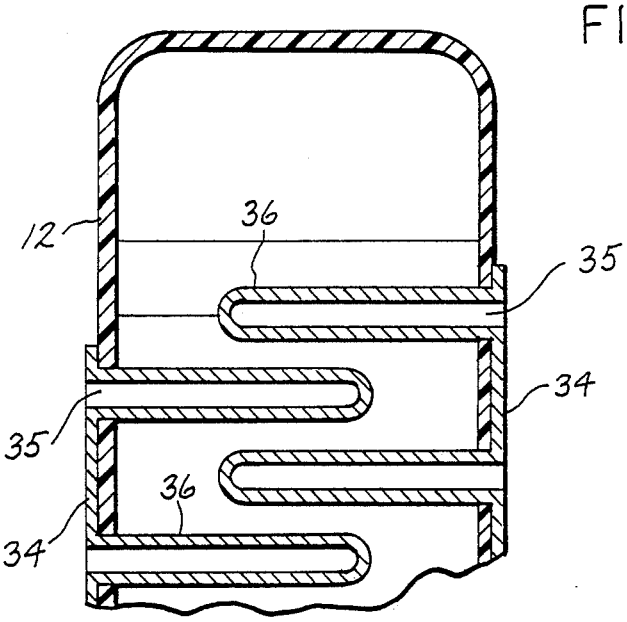
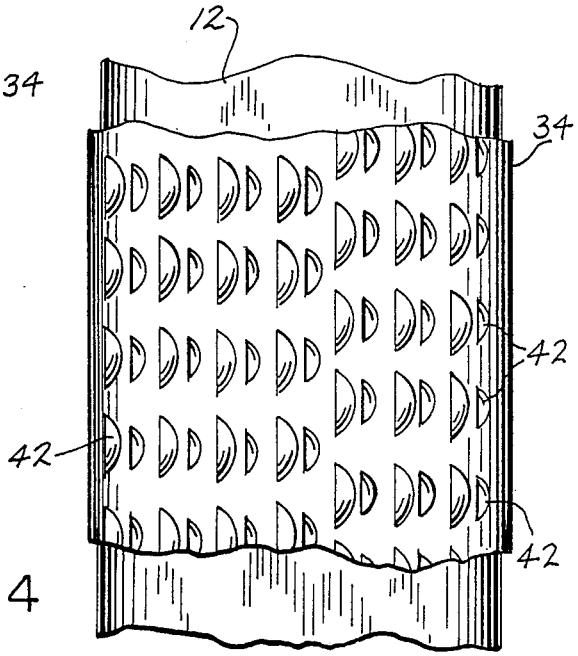
FIG. 4
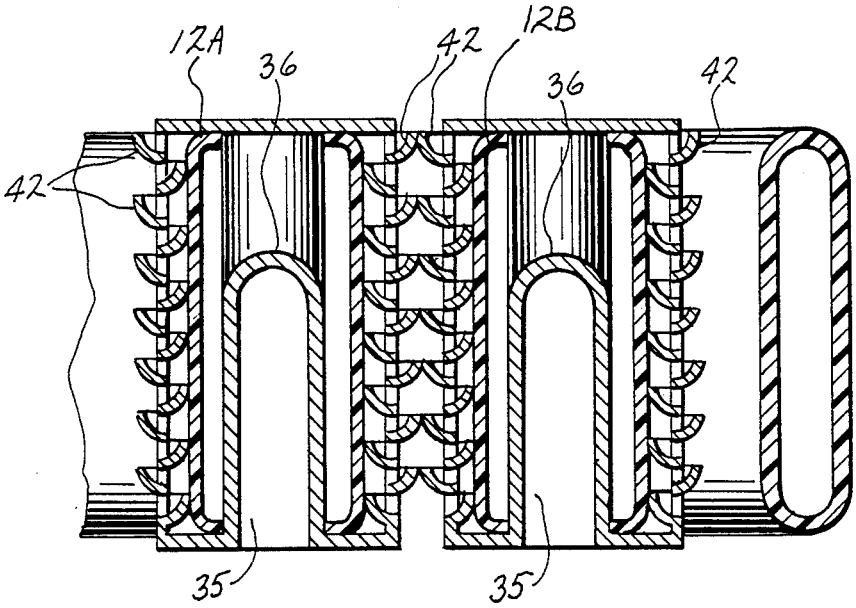
FIG. 5

PLASTIC VEHICULAR RADIATOR-CONDENSER WITH METAL COOLING INSERTS

BACKGROUND—FIELD OF INVENTION

This invention relates primarily to heat exchangers which are used in automobiles and trucks for cooling the internal engine and passenger compartment.

BACKGROUND OF INVENTION

Conventional heat exchangers such as those used in automobiles and trucks comprising of top and bottom headers and connecting tubes extending between the headers serve to carry within them a confined heat exchange medium such as water or liquid gas in conductive relationship with another medium such as air passing between the tubes.

This is unfortunately an expensive method of cooling an Internal Engine or passenger compartment in as much as the methods used involve a multiplicity of metal parts and operations such as sodering, handling and aligning of parts and joing them together.

It is also not uncommon for heat exchangers of this construction to have a number of tubes that become plugged causing expensive repair down the road.

OBJECTS AND ADVANTAGES

A principal object therefor of the invention is to provide a novel and improved heat exchanger free from the aforementioned disadvantages of construction and a method of constructing the same.

An object therefor of the invention is to provide a heat exchanger construction so designed with intergrated fluid conduits or chambers thereby being admirably suited to mass molded production.

One object therefor of this invention is the provision of two heat exchangers in one compact plastic molded unit which cuts down on manufacturing, packaging and automotive assembly line installation costs.

Another object is to provide a dual heat exchanger unit that will not exceed the overall outside physical dimensions of the system it is to replace on a motor vehicle.

A further object is the construction of a universal size nylon plastic body as described for use on different engine powertrains. This can be accomplished easily by simply changing the number of cavity formed interior baffles per aluminum cooling strip; the baffle strips being made on a high speed die formed rolling machine from coil stock; and bonded to each chamber.

More objects of the invention are to provide an improved heat transfer unit which is leakproof, neat, relatively rust proof with a ribbed body design for reinforcement and virtually maintenance free—as there are no tubes to ever plug up with solder corrosion, rust or scale that may be in the cooling system after prolonged use on the road.

Another object of the invention is to provide a greater overall heat transfer surface by using these metal cooling baffles inside of fluid conduits or chambers. In the condenser side of the plastic unit this greater heat transfer surface and turbulating effect can result in noticably less need for Freon gas—which has been shown to help destroy our ozone layer of the atmosphere.

Additionally, it has been estimated that over fifty percent of all cars and light trucks on the road today have partially closed radiator tubes which can cause poor coolant flow, potential overheating and radiator failure not to mention reduced fuel economy as a result. An object therefor of the invention is to eliminate these problems by providing a heat exchanger unit without traditional tubes to ever become restricted with solder and the like. It is within the spirit of the invention for the body of the unit to be molded from other materials besides nylon or if elected it can be stamped in metal on a metal press.

BRIEF DESCRIPTION OF THE DRAWINGS

The invention is illustrated in the accompanying drawings wherein:

FIG. 3 is a cross-sectional view taken along line 3—3 of FIG. 2;

FIG. 4 is a partial elevational view taken along line 4—4 of FIG. 2;

FIG. 5 is a cross-sectional view taken along line 5—5 of FIG. 2.

DETAILED DESCRIPTION OF THE DRAWINGS

Figure 1:
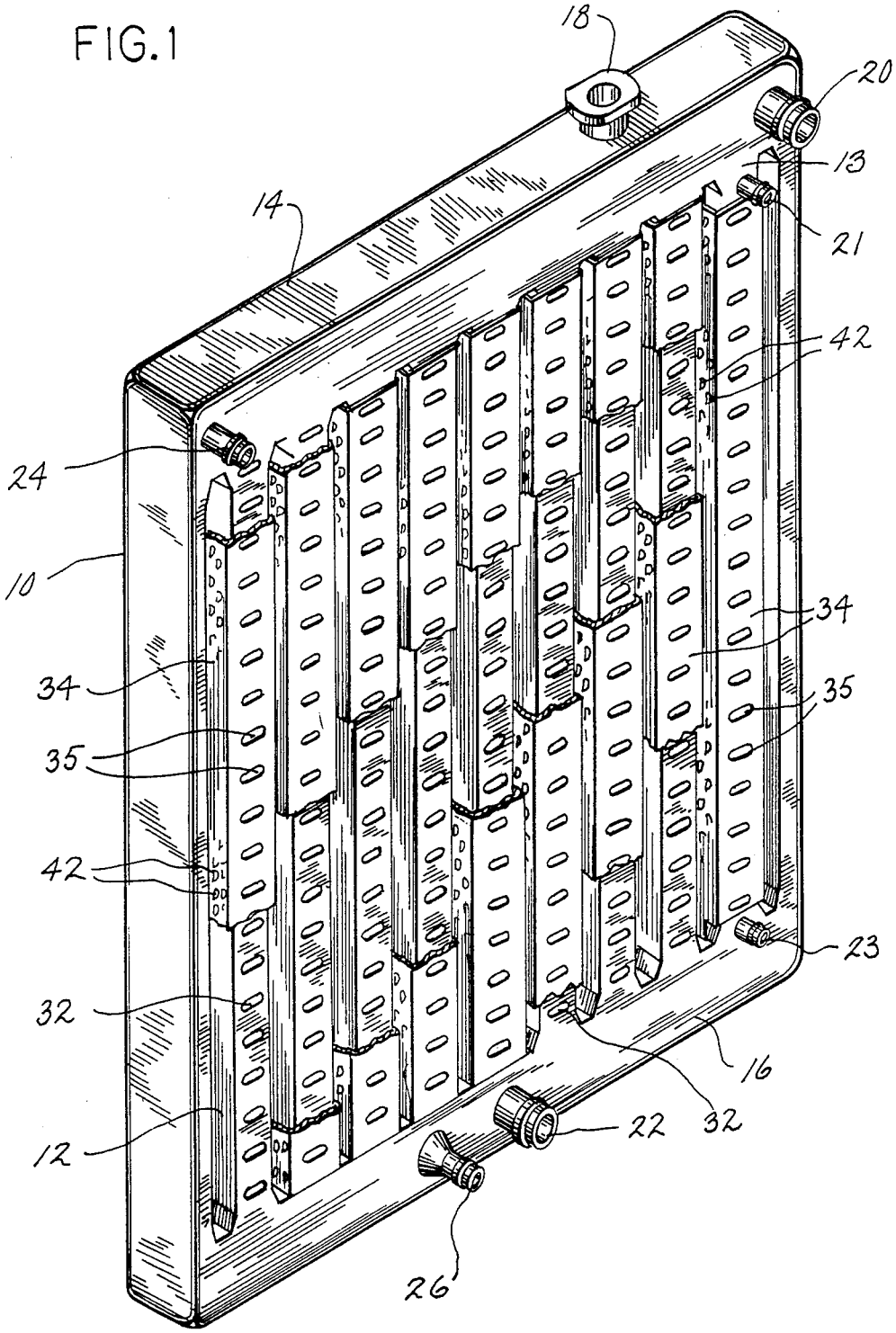
FIG. 1 is a perspective view of a plastic vehicular radiator-condenser with metal cooling inserts.

The radiator-condenser unit for motor vehicles as represented in FIG. 1, shows a molded body 10 with a number of connecting spaced conduits or chambers 12 extending vertically from the top tank 14 to the bottom tank 16 thereof. The chambers are slotted as indicated by reference number 32. Angular metal louvered 42 cooling strips 34 with deep cavity 35 formed heat transfer baffles are secured by bonding means to the face of the chambers with said baffles being projected through the slots 32 into chambers 12.

The radiator side is filled with water at the filler neck 18 on the top tank 14. The water is pumped thru the radiator by the water pump (not shown). It enters from the engine at inlet 20 on the top tank 14 and after it circulates it exits at the outlet 22 on the bottom tank 16 where it returns to the engine and then continues to make a cycle.

The engine's automatic transmission fluid enters an independent chamber 13 which is hydraulically isolated from the radiator tank 14 and chambers 12 by partiation wall **9*a* and 9*b* located at the ends thereof. Fluid enters at inlet 21 and is pumped thru said chamber by the transmission oil pump (not shown). It exits at outlet 23** after cooling down as it passes over the metal cooling baffles. The cycle is repeated while the engine is running.

In the air conditioning side of the unit, Freon gas enters at inlet 24 on the top tank 14. The gas is pumped under high pressure thru the condenser by the action of the compressor (not shown). After it circulates, the liquid gas exits at outlet 26 on the bottom tank 16. This cycle continues until the desired cooling temperature is reached in the passenger compartment.

As fluids pass over these baffles heat is taken out of the liquid and transfered thru said baffles to the louvered 42 surface of the metal strips 34 where it is cooled off by the action of the internal engines fan and movement of the vehicle.

Figure 2:
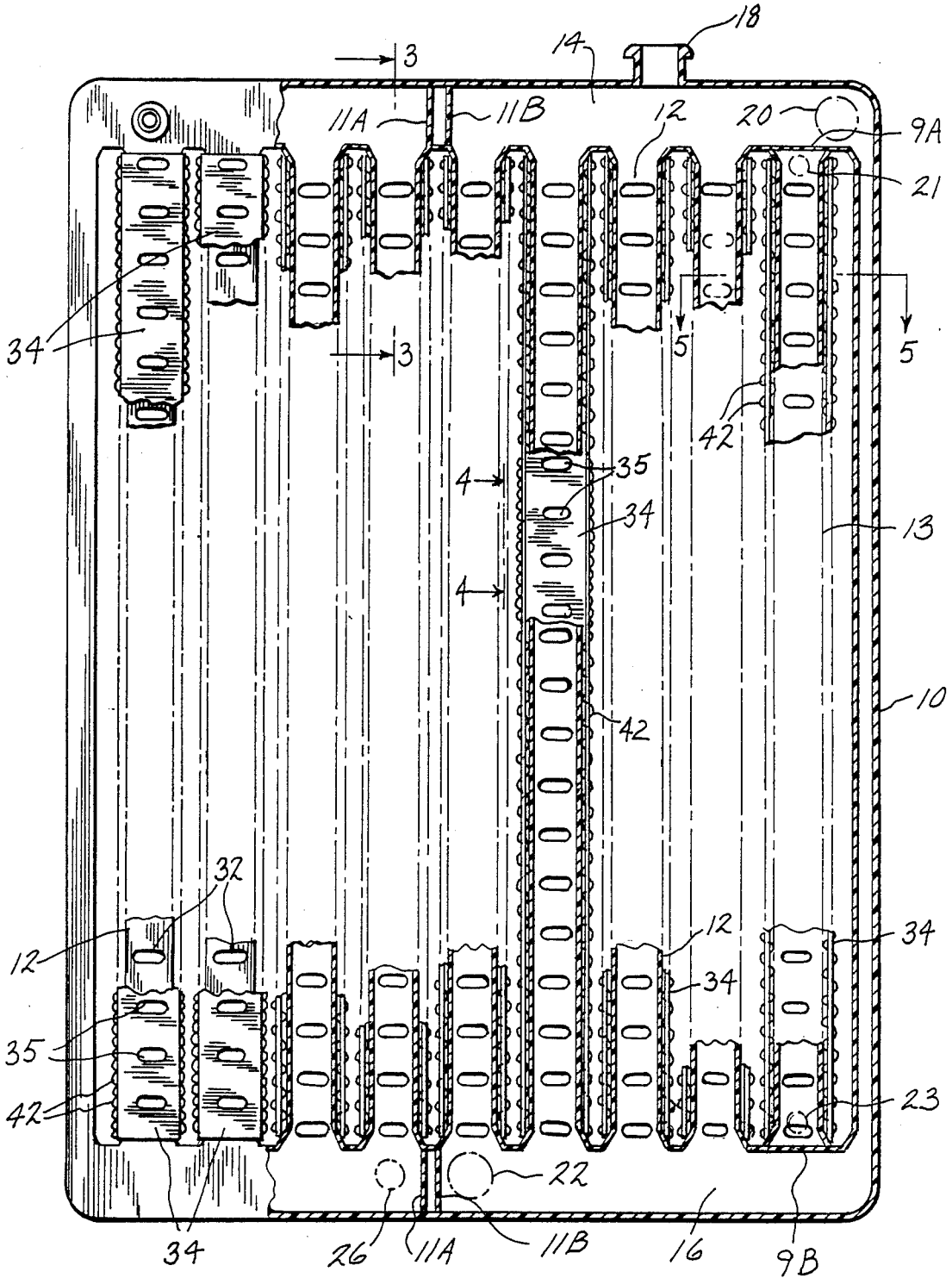
FIG. 2 is a front view with parts broken away.

FIG. 2 is a front view of the radiator-condenser body with heat transfer parts broken away and showing two inside divider walls, **11*a* and 11*b* which run parallel from the top tank 14 to the bottom tank 16**; so as to thermally insulate the Freon gas from the liquid water within the system.

FIG. 3 is a cross-sectional view of the front and back of a typical chamber 12 with two metal cooling strips 34 shown, taken along line 3—3 of FIG. 2; containing deep cavity 35 formed heat transfer baffles 36, projected inside said chamber.

FIG. 4 is a partial elevational view taken along line 4—4 of FIG. 2 and showing a multitude of louvers 42 on the side of an angular metal cooling strip 34 which is secured by bonding means to a chamber 12.

FIG. 5 is a cross-sectional view of two spaced chambers **12*a* and 12*b* taken along line 5—5 of FIG. 2; each displaying a deep cavity 35 formed heat transfer baffle 36 projected inside the slotted chamber 12**.

Having described the nature of my said invention and in what manner the same is to be performed, I declare that which I claim is:

1. A heat exchanger comprising an upper header, a lower header, and a plurality of tubular chambers extending and defining flow paths therebetween, said tubular chambers being spaced from each other to further define open spaces therebetween; said headers and tubular chambers forming a substantially planar member having a front face and a rear face on opposed sides thereof; each said tubular chamber having a front surface and a rear surface lying substantially in said front and rear faces of said heat exchanger, respectively, and having at least one cooling strip attached to its front or rear surface by means of baffles penetrating said surface and projecting into said tubular chamber; said cooling strips extending at least partially around said tubular chambers and into the space between adjacent tubular chambers, said portion of said strips extending into said space between adjacent tubular members having formed thereon louvers for enhancing heat transfer from said strip.

* * * * *